US008631794B2

(12) United States Patent
Busch et al.

(10) Patent No.: US 8,631,794 B2
(45) Date of Patent: Jan. 21, 2014

(54) GAS MASK

(75) Inventors: Alexander Busch, Luebeck (DE); Dirk Feil, Luebeck (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 264 days.

(21) Appl. No.: 13/019,745

(22) Filed: Feb. 2, 2011

(65) Prior Publication Data

US 2011/0209712 A1 Sep. 1, 2011

(30) Foreign Application Priority Data

Feb. 26, 2010 (EP) ..... 10154805

(51) Int. Cl.
*A62B 18/10* (2006.01)
*A62B 9/02* (2006.01)

(52) U.S. Cl.
USPC ..... 128/207.12; 128/206.21; 128/205.25; 128/205.24; 128/204.27; 128/204.26

(58) Field of Classification Search
USPC ..... 128/857, 200.24, 200.28, 201.15, 128/201.22–201.28, 202.27, 203.29, 128/204.18, 204.26, 204.29, 205.24, 128/205.25, 206.21, 207.12
See application file for complete search history.

(56) References Cited

U.S. PATENT DOCUMENTS

| | | | | | |
|---|---|---|---|---|---|
| 4,071,025 | A * | 1/1978 | Kohnke | 128/205.13 |
| 4,606,340 | A * | 8/1986 | Ansite | 128/205.24 |
| 5,086,768 | A * | 2/1992 | Niemeyer | 128/205.24 |
| 5,159,641 | A * | 10/1992 | Sopko et al. | 381/367 |
| 5,499,624 | A * | 3/1996 | Kruger et al. | 128/204.26 |
| 5,623,923 | A * | 4/1997 | Bertheau et al. | 128/207.11 |
| 6,016,802 | A * | 1/2000 | Jackson | 128/205.25 |
| 7,575,004 | B2 * | 8/2009 | Weich et al. | 128/204.26 |
| 2006/0086360 | A1 * | 4/2006 | Weich et al. | 128/207.12 |

FOREIGN PATENT DOCUMENTS

| | | |
|---|---|---|
| DE | 102004052173 B3 | 1/2006 |
| EP | 0 667 171 B1 | 8/1995 |
| GB | 2 264 646 A | 9/1993 |
| IT | 1 227 248 | 3/1991 |

* cited by examiner

*Primary Examiner* — Annette Dixon
(74) *Attorney, Agent, or Firm* — McGlew and Tuttle, P.C.

(57) ABSTRACT

A gas mask is provided for normal-pressure and overpressure operation with at least one breathing port, an expiration valve with a valve spring, an adjusting element affecting the prestress of the valve spring and a pushing element having a first switching position and a second switching position. The pushing element is designed to act on the adjusting element during a translatory motion from the first switching position into the second switching position. A change in the prestress of the valve spring can be brought about and a switchover from a "normal pressure" mode into an "overpressure" mode can thus be carried out.

20 Claims, 7 Drawing Sheets

GAS MASK

CROSS REFERENCE TO RELATED APPLICATIONS

This application claims the benefit of priority under 35 U.S.C. §119 of European Patent Application EP 10 154 805.5 filed Feb. 26, 2010 the entire contents of which are incorporated herein by reference.

FIELD OF THE INVENTION

The present invention pertains to a gas mask for normal-pressure and overpressure operation.

BACKGROUND OF THE INVENTION

Gas masks are used, for example, for fighting unintended fires that may cause damage and when handling hazardous substances and materials. Gas masks with the "normal pressure" and "overpressure" modes are known.

The "normal pressure" mode is present, for example, when a breathing filter is connected to the gas mask. The pressure level in the interior of the gas mask corresponds now to the atmospheric ambient pressure. The "overpressure" mode is present, for example, when a demand oxygen system of a compressed air breathing apparatus is connected to the gas mask. The pressure level in the interior of the gas mask is now higher than that of the atmospheric ambient pressure. Toxic gases are thus effectively prevented from entering the mask.

However, it is not necessary to generate an overpressure for each application. The air breathed in by the user of the mask directly is purified, for example, by a filter located at a breathing port in the "normal pressure" mode. The expiration valve is usually closed and opens only during the expiration phase of the mask user due to the expiration pressure developing in the mask. The pressure level within the mask corresponds to the level of the outside pressure in the "normal pressure" mode.

The pressure level within the mask is shifted in the "overpressure" mode by a certain positive amount compared to the level of the outside atmospheric pressure, so that the internal pressure in the mask is above the respective atmospheric pressure during both inspiration and expiration. The expiration valve opens during the expiration phase here as well due to the expiration pressure generated in the mask. In addition, the expiration valve must close against the now existing pressure gradient.

Thus, different pressures act on the expiration valve as a function of the mode of operation. The expiration valve must consequently be controlled corresponding to the respective mode of operation in case of a gas mask with the "normal pressure" and "overpressure" modes.

IT 1 227 248 discloses a spring, which counteracts the opening of the outlet valve and which acts on a pin projecting towards the outside of the mask. The pin is arranged such that it is pressed to increase the pressure of the spring when the internal pressure of the mask is increased, for example, by connecting a compressed air breathing apparatus.

A gas mask with two series-connected springs having different prestresses is known from EP 0 667 171 B1. The spring with the lower prestress is active when the mask is used in the filter operation, whereas the spring with the higher prestress is activated during use with a demand oxygen system, i.e., with overpressure in the mask.

DE 10 2004 052 173 B3 shows a gas mask of the type mentioned, in which a prestress of a valve spring can be varied by means of an adjusting means, wherein said adjusting means is designed as an angle lever pivotable about an axis of rotation.

SUMMARY OF THE INVENTION

The basic object of the present invention is to improve a gas mask with the "normal pressure" and "overpressure" modes such that a switchover between the modes is possible in a simple manner. This object is accomplished by a gas mask for normal-pressure operation and overpressure operation with the features according to the present invention.

The object is accomplished by the gas mask according to the present invention having at least one breathing port, an expiration valve with a valve spring, an adjusting element affecting the prestress of the valve spring, and a pushing element with first and second switching positions. The pushing element is designed, furthermore, to act on the adjusting element during the translatory motion from the first switching position into the second switching position, so that a change in the prestress of the valve spring can be achieved and a switchover from the "normal pressure" mode to the "overpressure" mode can thus be carried out.

A switchover from the "normal pressure" mode into the "overpressure" mode and vice versa can thus be carried out in a simple manner for the user.

In a first advantageous embodiment of the gas mask according to the present invention, the adjusting element may be designed as a pivotable lever arm. The lever arm preferably has a transmission element, which is designed such that it is oblique to the plane of the pushing element in an upper position of the lever arm, wherein the pushing element can be moved over the slope of the transmission element and the transmission element is arranged at the lever arm such that the lever arm presses the valve spring during a motion of the pushing element.

In another advantageous embodiment, the pushing element has on the sides at least one locking element each for locking the pushing element in the first switching position and in the second switching position. Thus, the respective mode can be set securely for the user on the gas mask, on the one hand, and the respective mode can be unambiguously identified, on the other hand.

The pushing element is advantageously designed as an elastic double clasp with two locking elements each on the front surfaces, wherein a moving together of the two locking elements of one front surface brings about the moving apart of the locking elements of the other front surface. In the cooperation of this elastic double clasp with a cover with two front-side openings each, which surrounds the pushing element, the respective front-side locking elements pass through the respective opening of the cover in both the first switching position and the second switching position. The locking in the respective desired switching position takes place, by principle, automatically because of the spring action of the double clasp. Locking of the pushing element can thus be brought about in a simple manner in both the first switching position and the second switching position.

For optimally guiding the pushing element from the first switching position into the second switching position and back, the locking elements have a grip area each. By means of the grip area, the pushing element can be released from the locking and displaced manually in a simple manner.

By principle, opposite deflection of both locking elements is necessary for unlocking based on the redundant design of the locking elements in the double clasp. An accidental unlocking of the pushing element can thus be prevented from occurring in a simple manner in both the first switching position and the second switching position.

In another embodiment, at least one locking element is designed as a visual indicator for recognizing a setting of the "normal pressure" and "overpressure" modes. The at least one locking element is preferably arranged at the mask body such that the position of the locking element is recognizable by the user of the mask by means of the mask visor. The particular set mode of the gas mask can thus be recognized by the user of the mask in a simple manner.

As an alternative hereto, a signal transmitter for recognizing the first and second switching positions of the pushing element may be provided at the pushing element. Furthermore, a detection element may be provided, which is preferably designed as an induction proximity switch, a Reed switch or a Hall sensor. The detection element is preferably arranged in a mask body. The "normal pressure" and "overpressure" modes can be advantageously displayed optically in the mask visor.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
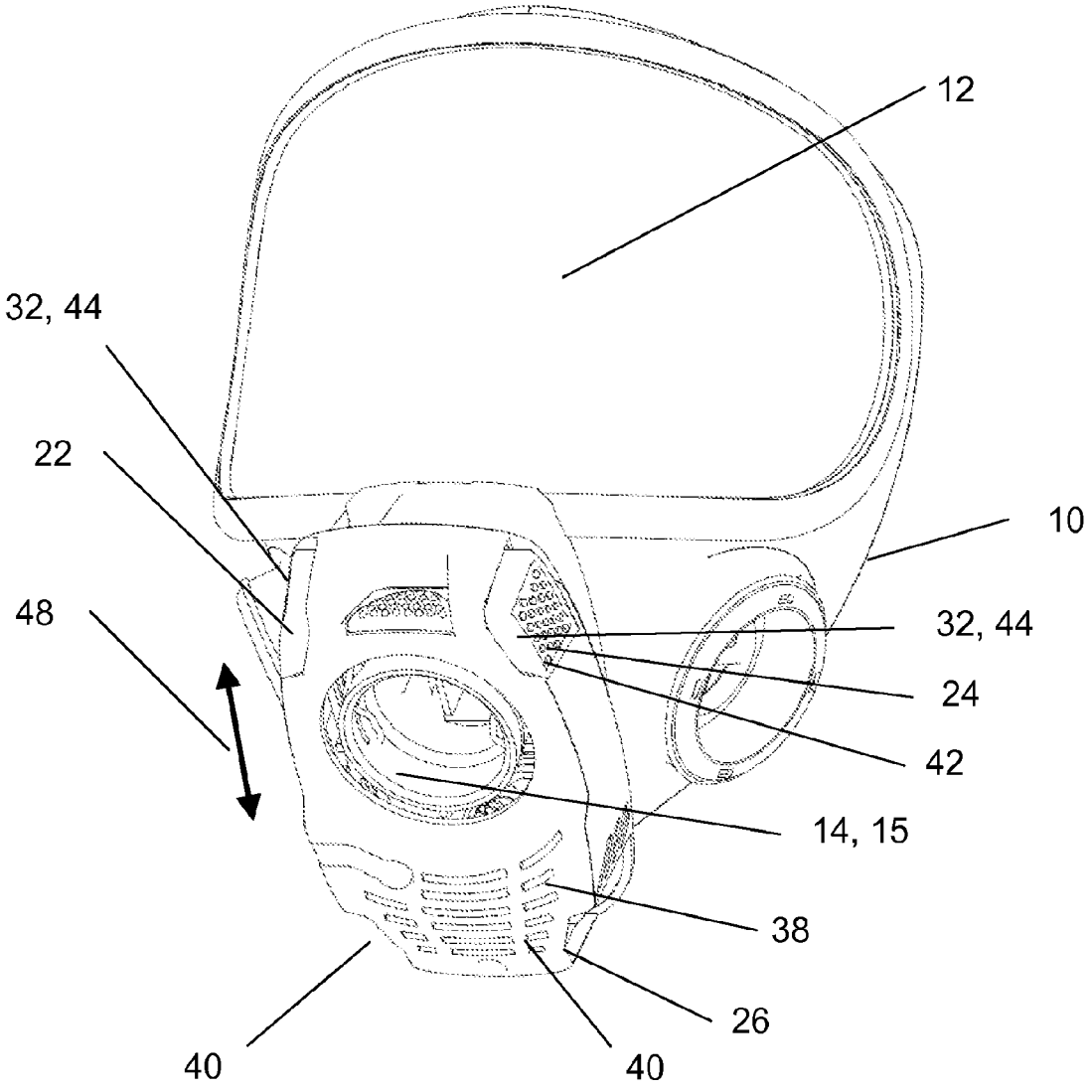
FIG. 1 is a schematic view of the gas mask in a first switching position of a pushing element.

Referring to the drawings in particular, FIG. 1 schematically shows a detail of the gas mask according to the present invention with a mask body 10 and a mask visor 12. A breathing port 14 is provided on the mask body 10. The breathing port 14 has an opening 15 for a connection of a demand oxygen system in the "overpressure" mode on its side in the design embodiment being shown.

A filter is connected at a second port arranged laterally in the mask body in the design embodiment being shown.

Figure 2:
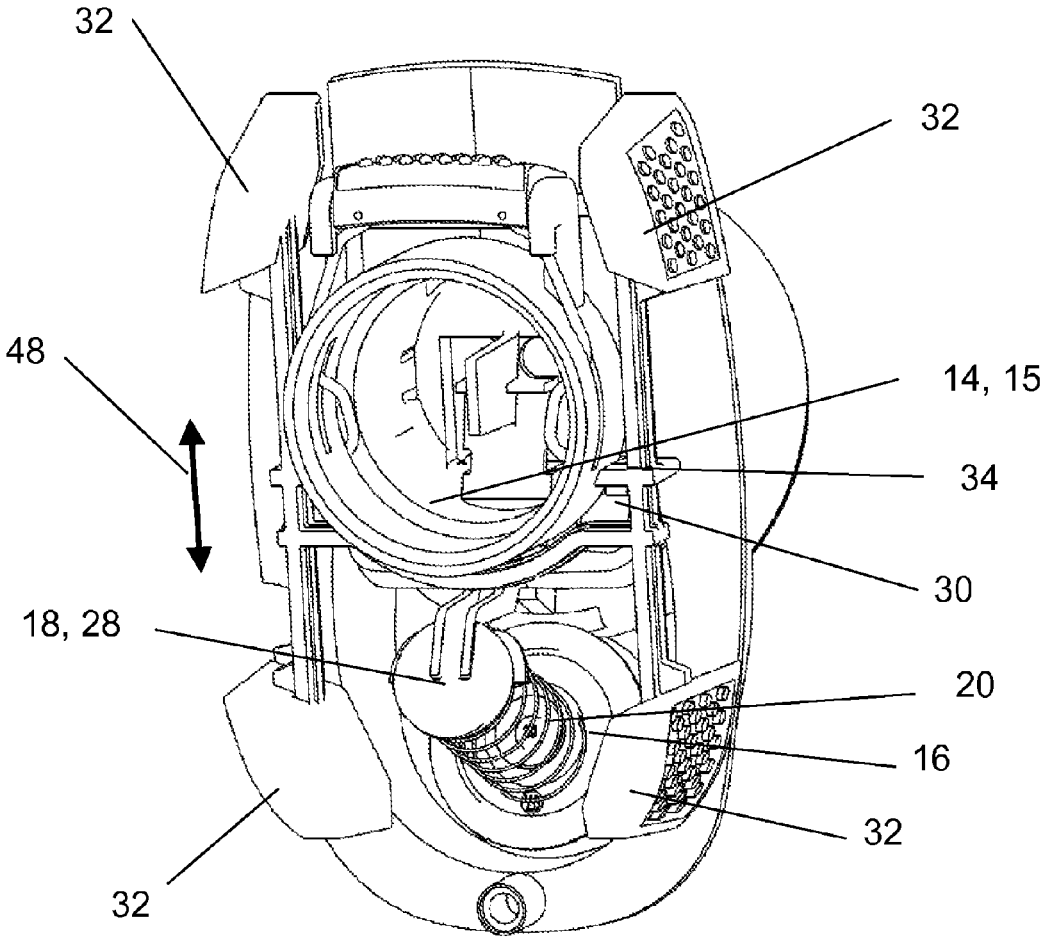
FIG. 2 is a schematic view of the pushing element in cooperation with an adjusting element in the first switching position shown in FIG. 1.

A pushing element 22 (shown in FIG. 3) is surrounded by a cover 38. The pushing element 22 may alternate by a translatory motion between a first switching position 24 and a second switching position 26. An arrow 48 indicates the direction of motion between the first switching position 24 and the second switching position 26. The pushing element 22 acts on an adjusting element 18 during the translatory motion. The adjusting element 18 is shown in FIG. 2 and is designed as a pivotable lever arm 28. Furthermore, a transmission element 30, which is in an oblique position to the plane of the pushing element 22 in an upper position of the lever arm 28, is formed at the pivotable lever arm 28. Pushing element 22 acts on the slope of the transmission element 30 during a motion between the two switching positions 24 and 26. The transmission element 30 is arranged at the lever arm 28 such that lever arm 28 presses a valve spring 20 during the motion of the pushing element 22.

In the embodiment shown in FIG. 1, the pushing element 22 is in the first switching position 24. The valve spring 20 is in a relaxed state in the first switching position 24 and generates only a minimal prestress on the expiration valve 16. The first switching position 24 corresponds to the "normal pressure" mode.

Figure 3:
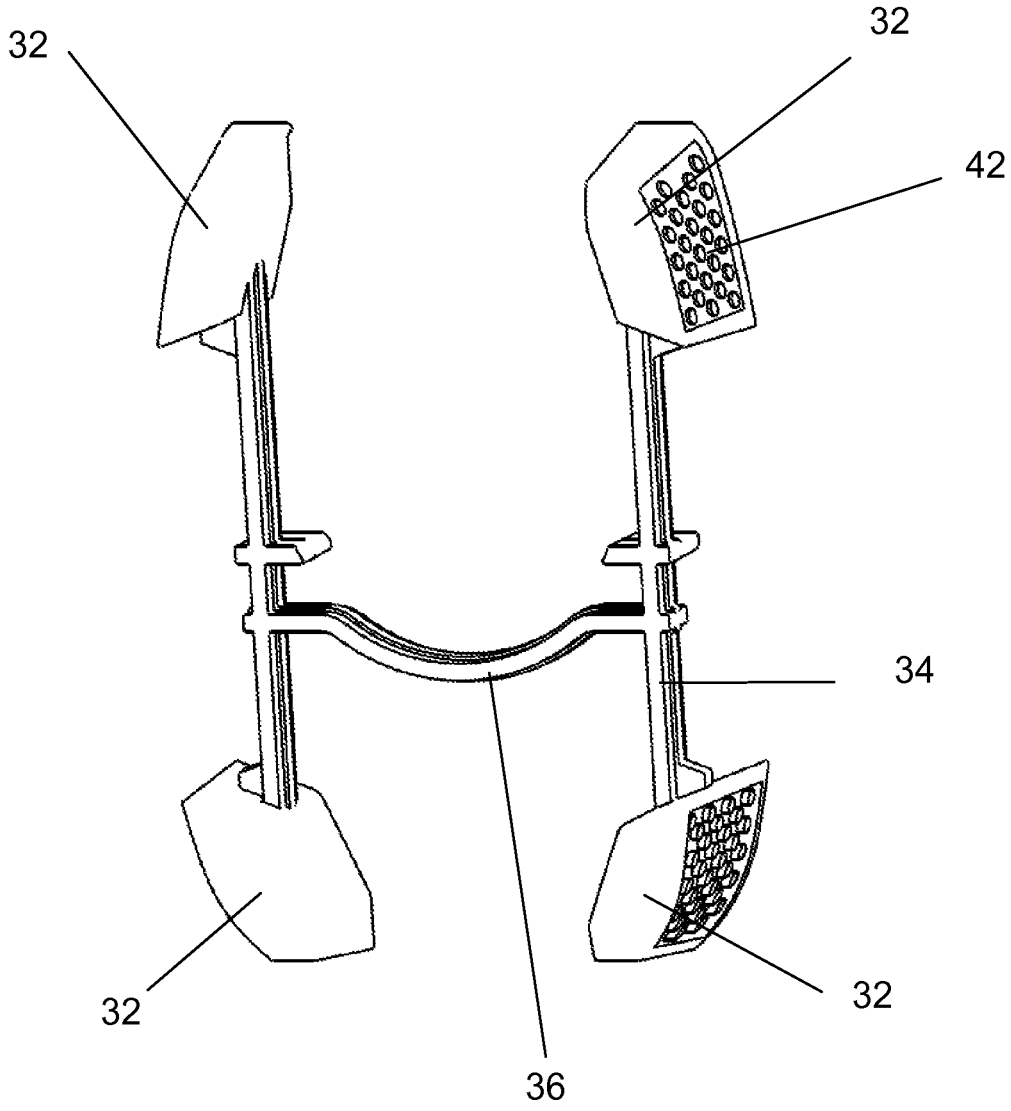
FIG. 3 is a schematic view of an embodiment of the pushing element.

FIG. 3 schematically shows a design of the pushing element 22. The pushing element 22 is designed as an elastic double clasp 34. The elastic double clasp 34 comprises two lateral webs, which are connected to one another via a connection web 36. Connection web 36 is made elastic. The locking elements 32 are arranged at the respective ends of the lateral webs. Moving together of the two locking elements 32 on one side brings about the moving apart of the two locking elements 32 of the other side.

Pushing element 22 is movably guided within cover 38. Cover 38 has two side openings 40. In the embodiment shown in FIG. 1, the side locking elements 32 pass through the openings 40 of the cover 38 and fix the pushing element 22 in the first switching position 24.

The locking elements 32 have, furthermore, a grip area 42. Pushing element 22 can be released with the grip areas 42 from the locking by a motion of the locking elements 32 in the first switching position 24 and displaced manually in the direction of the second switching position 26. Pushing element 22 can be moved under the cover 38 into the second switching position 26. The locking elements 32 protrude through the openings 40 of the cover 38 in the second switching position and thus fix the pushing element 22 in the second switching position 26 (shown in FIG. 4).

The pushing element 22 is moved over the slope of the transmission element 30 during the displacement of the pushing element 22 from the first switching position 24 into the second switching position 26, while the transmission element is rigidly coupled with the lever arm 28 and presses same onto the valve spring 20. The opening pressure of the expiration valve 16 is increased due to the compression of the valve spring 20 and the greater prestress acting on the expiration valve 16, which is associated therewith. The prestress of the valve spring 20 and hence the opening pressure of the expiration valve 16 can be affected by varying the slope of the transmission element 30 and the ratio of the length of the transmission element 30 to the length of lever arm 28.

Figure 4:
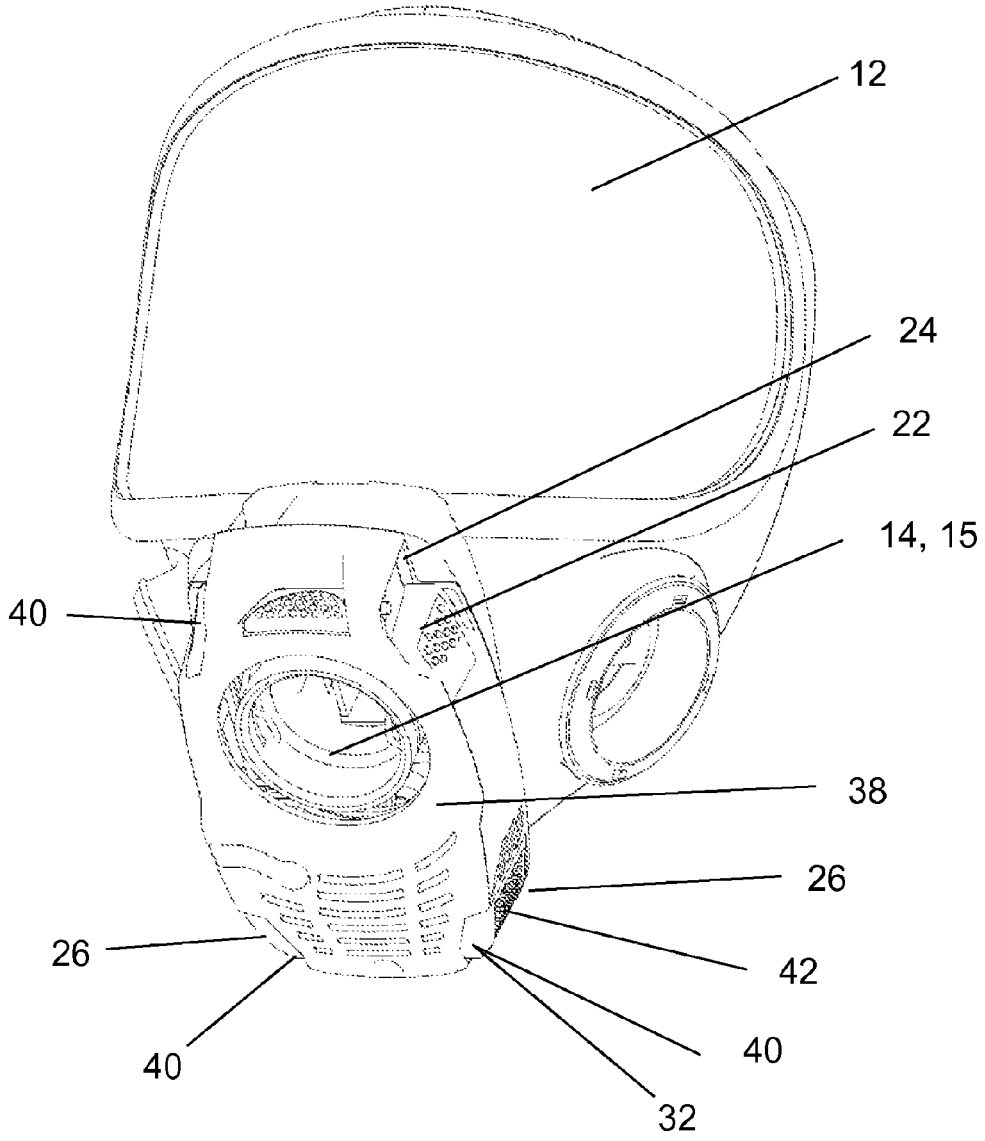
FIG. 4 is a schematic view of the gas mask in a second switching position of the pushing element.
Figure 5:
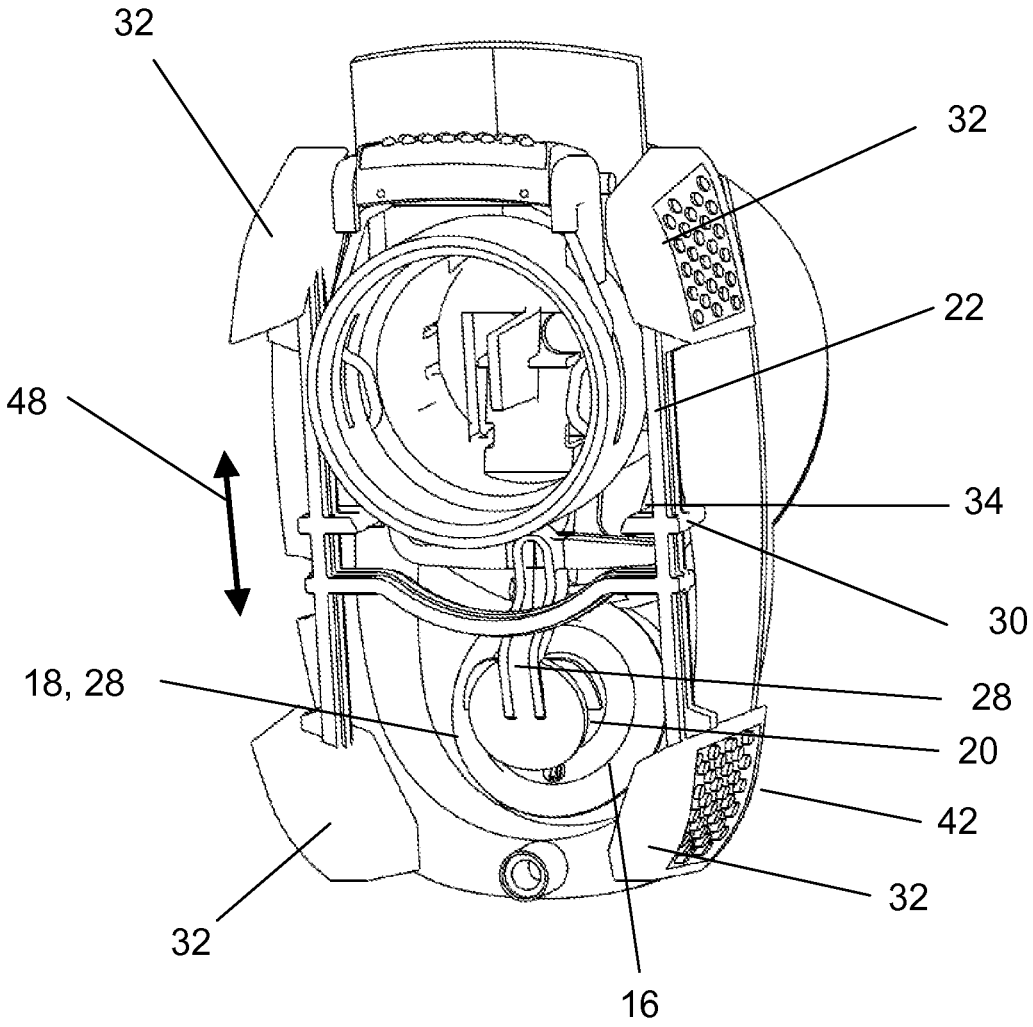
FIG. 5 is a schematic view of the pushing element in cooperation with the adjusting element in the second switching position shown in FIG. 3.

FIG. 4 shows the pushing element 22 in the second switching position 26. Valve spring 20 has the maximum prestress in switching position 26. Lever arm 28 is located in the vicinity of the expiration valve 16 (shown in FIG. 5). This second switching position 26 corresponds to the "overpressure" mode.

The side locking elements 32 are designed in the first switching position 24 shown in FIG. 1 such that they can be recognized by the user of the mask through the mask visor 12. The locking elements 32 thus have a dual function in the first switching position 24. On the one hand, they lock the pushing element 22 and are used, on the other hand, as visual indicators 44 for recognition of the first switching position 24 and hence the "normal pressure" mode by the mask user.

The locking elements 32 of the first switching position 24 or the visual indicators 44 are outside the visual field of the mask user in the second switching position 26. The mask user can thus advantageously recognize the setting of the gas mask according to the present invention in the "normal pressure" mode and in the "overpressure" mode in a simple manner.

Figure 6:
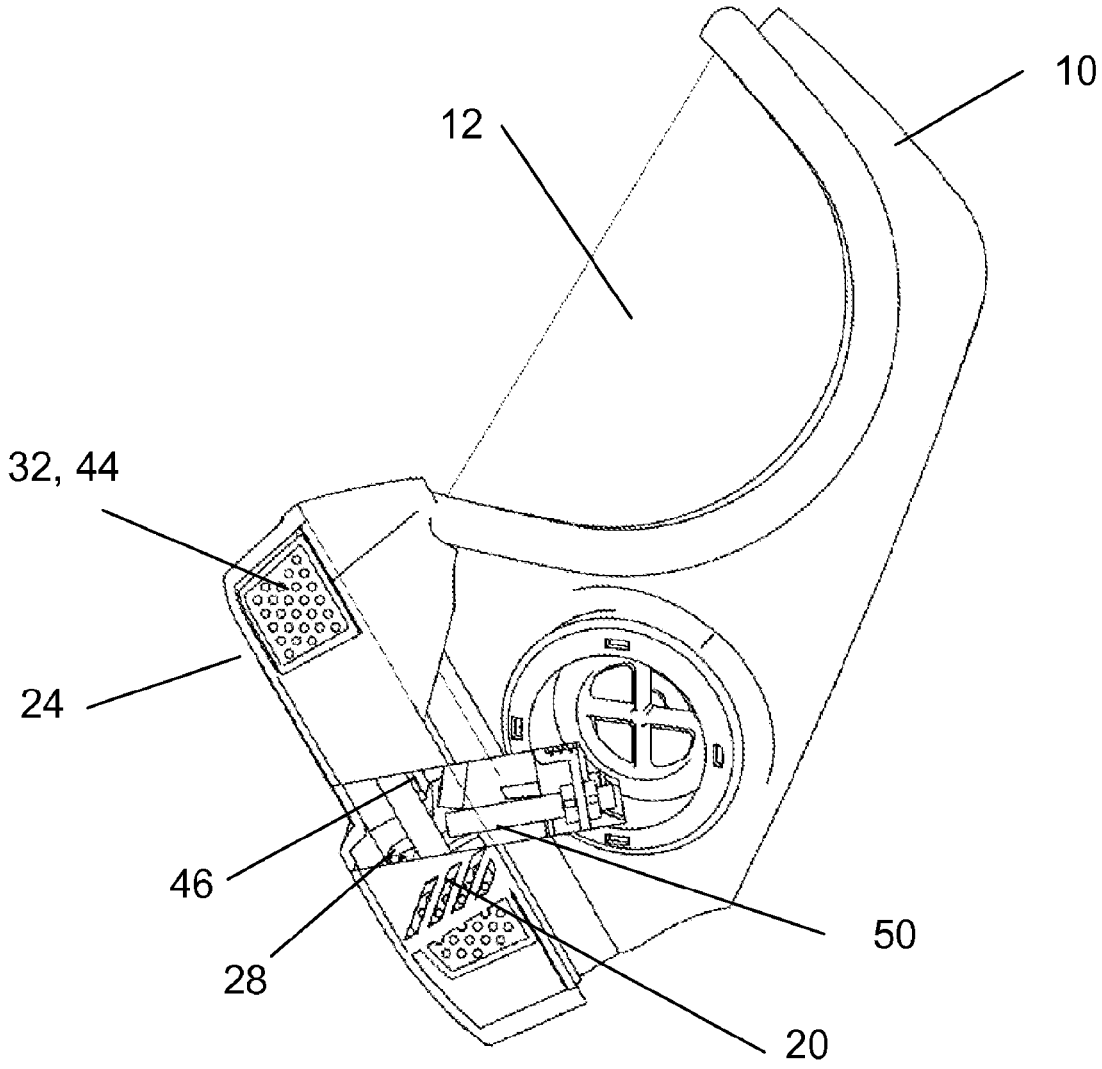
FIG. 6 is a schematic view of the gas mask in the embodiment with a signal transmitter in the first switching position.
Figure 7:
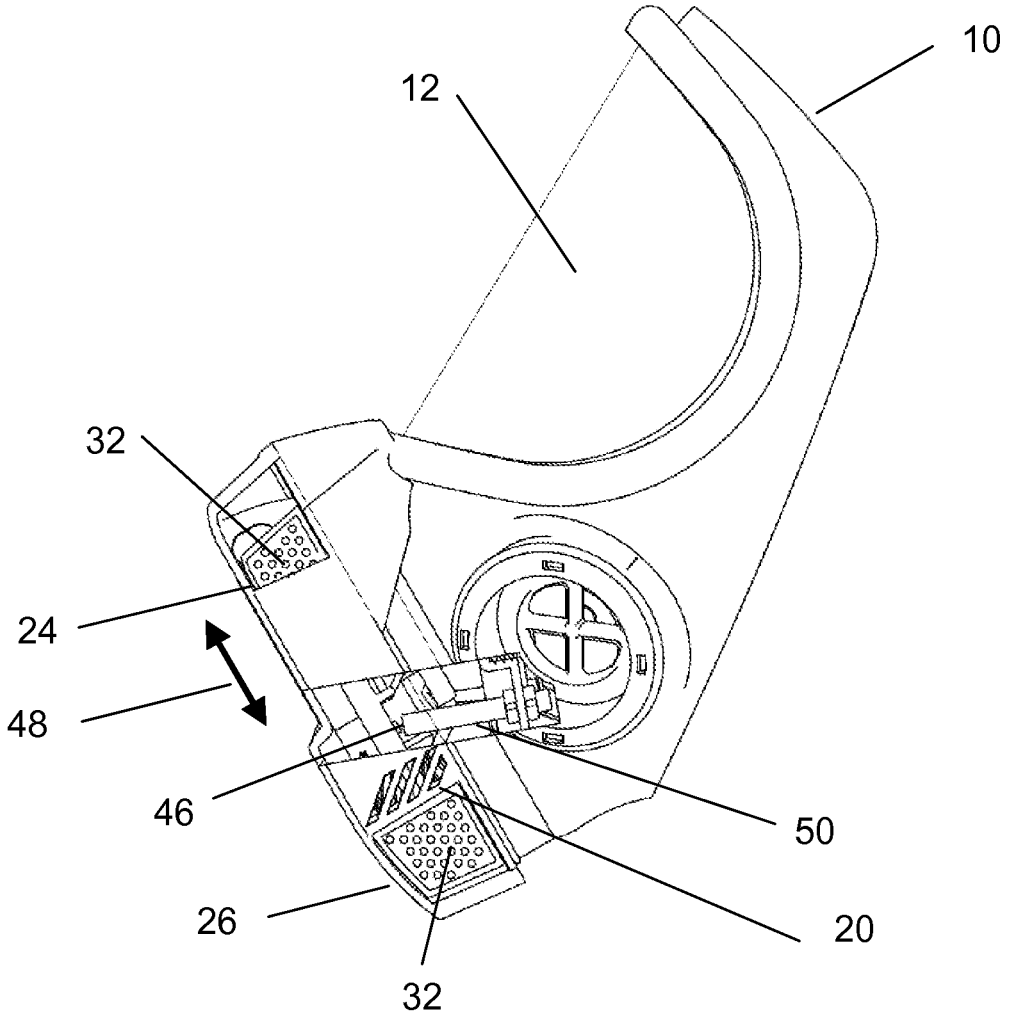
FIG. 7 is a schematic view of the gas mask with a signal transmitter in a second switching position.

As an alternative hereto, the schematic views in FIGS. 6 and 7 show an embodiment with a signal transmitter 46 provided at the pushing element 22. Furthermore, a detection element 50 is provided, which is preferably arranged in the mask body 10.

FIG. 6 shows the pushing element 22 in the first switching position 24 with a relaxed valve spring 20. Valve spring 20 has a minimal prestress, as a result of which a low opening pressure is necessary for opening the expiration valve 16. Detection element 50 detects the position of the pushing element 22 by means of a signal of the signal transmitter 46 in this "normal pressure" mode. The detection element 50 is connected with a display element, which is arranged in the mask body 10 and which optically signals the "normal pressure" mode. The display element may be designed as an LED. The display may optically display the mode in the mask visor.

FIG. 7 shows the pushing element 22 in the second switching position 26. Valve spring 20 has a maximum prestress, as a result of which the opening pressure of the expiration valve 16 is increased. The position of the pushing element 22 is recognized by the detection element 50, which in turn detects a signal of the signal transmitter 46 arranged at the pushing element 22. The second switching position 26 of the pushing element 22 and hence the setting of the "overpressure" mode on the gas mask can thus be recognized by the detection element 50. A display element in the mask body 10 (not shown), which display element is connected to the detection element 50, signals the "overpressure" mode.

Detection element 50 may be designed as an induction proximity switch or as a magnetic switch embodied as a Reed switch or Hall sensor.

While the present invention was described with reference to the preferred exemplary embodiments, various changes and modifications are obvious to the person skilled in the art. All these changes and modifications should fall within the scope of protection of the claims given.

While specific embodiments of the invention have been described in detail to illustrate the application of the principles of the invention, it will be understood that the invention may be embodied otherwise without departing from such principles.

LIST OF REFERENCE NUMBERS

10 Mask body
12 Mask visor
14 Breathing port
15 Opening
16 Expiralion valve
18 Adjusting element
20 Valve spring
22 Pushing clement
24 First switching position
26 Second switching position
28 Lever arm
30 Transmission clement
32 Locking element
34 Double clasp
36 Connection web
38 Cover
40 Openings
42 Grip area
44 Visual indicator
46 Signal transmitter
48 Pushing direction
50 Detection element

What is claimed is:

1. A gas mask for normal pressure and overpressure modes, the gas mask comprising:
one or more breathing ports;
an expiration valve with a valve spring;
an adjusting element affecting a prestress of the valve spring; and
a pushing element moveable between a first switching position and a second switching position, the pushing element comprising a grip area for being engaged by a user to move the pushing element between the first switching position and the second switching and comprising a pushing surface acting on the adjusting element during a translatory motion from the first switching position into the second switching position, so that a change in the prestres of the valve spring is brought about and a switchover from the normal pressure mode to the overpressure mode is carried out.

2. A gas mask in accordance with claim 1, wherein the adjusting element comprises a pivotable lever arm.

3. A gas mask in accordance with claim 2, wherein:
the lever arm has at least one transmission element that is oblique in relation to the plane of the pushing element in an upper position of the lever arm;
the pushing element can be moved over a slope of the transmission element; and
the transmission element is arranged at the lever arm such that the lever arm is pressed onto the valve spring during a motion of the pushing element.

4. A gas mask in accordance with claim 1, wherein pushing element has, on a side, at least one locking element for locking the pushing element in the first switching position and in the second switching position.

5. A gas mask in accordance with claim 4, wherein the locking elements have a grip area, by means of which the pushing element can be released from the locking and manually displaced.

6. A gas mask in accordance with claim 1, wherein:
the pushing element comprises an elastic double clasp with two locking elements each on a side; and
a moving together of the two locking elements of one side brings about a moving apart of the locking elements of the other side.

7. A gas mask in accordance with claim 6, further comprising a cover with two side openings, wherein the cover surrounds the pushing element.

8. A gas mask in accordance with claim 7, wherein the side locking elements protrude through the respective openings of the cover in the first switching position and in the second switching position and bring about locking of the pushing element in the first switching position and in the second switching position.

9. A gas mask in accordance with claim 1, wherein at least one locking element comprises a visual indicator for recognizing a setting of the normal pressure and overpressure modes.

10. A gas mask in accordance with claim 9, further comprising a mask body with a mask visor, wherein at least one locking element is arranged at the mask body such that a position of the locking element can be recognized through the mask visor.

11. A gas mask in accordance with claim 1, further comprising a signal transmitter provided at the pushing element, wherein the signal transmitter signals the first switching position and the second switching position of the pushing element.

12. A gas mask in accordance with claim 11, further comprising a detection element comprising at least one of an induction proximity switch, a Reed switch and as a Hall sensor.

13. A gas mask in accordance with claim 12, further comprising a mask body wherein the detection element is arranged in the mask body.

14. A gas mask in accordance with claim 1, further comprising a mask visor wherein the normal pressure and the overpressure modes can be optically displayed in the mask visor.

15. A gas mask comprising:

a mask body defining a mask interior;

a breathing port;

an expiration valve with a valve spring;

an adjusting element in contact with the valve spring and acting on the valve spring for affecting a prestress of the valve spring; and a pushing element supported relative to the mask body and moveable between a first switching position and a second switching position, the pushing element comprising a grip area for being engaged by a user to move the pushing element between the first switching position and the second switching and comprising a pushing surface acting on the adjusting element during a translatory motion from the first switching position into the second switching position, so that a change in the prestress of the valve spring is brought about and there is a switchover from a normal mode in which a pressure level in the mask interior corresponds to atmospheric ambient pressure to an overpressure mode in which a pressure level in the mask interior is higher than that of the atmospheric ambient pressure.

16. A gas mask in accordance with claim 15, wherein:

the adjusting element comprises a pivotable lever arm;

the lever arm has at least one transmission element that is oblique in relation to a plane of the pushing element in an upper position of the lever arm;

the pushing element can be moved over a slope of the transmission element; and the transmission element is arranged at the lever arm such that the lever arm is pressed onto the valve spring during a motion of the pushing element.

17. A gas mask in accordance with claim 15, wherein pushing element has, on a side, at least one locking element for locking the pushing element in the first switching position and in the second switching position.

18. A gas mask in accordance with claim 15, further comprising:

a signal transmitter provided at the pushing element, wherein the signal transmitter signals the first switching position and the second switching position of the pushing element; and a detection element comprising at least one of an induction proximity switch, a Reed switch and a Hall sensor.

19. A gas mask comprising:

a mask body defining a mask interior;

a breathing port;

an expiration valve with a valve spring;

an adjusting element affecting a prestress of the valve spring;

a pushing element having a first switching position and a second switching position, the pushing element acting on the adjusting element during a translatory motion from the first switching position into the second switching position, so that a change in the prestress of the valve spring is brought about and there is a switchover from a normal mode in which a pressure level in the mask interior corresponds to atmospheric ambient pressure to an overpressure mode in which a pressure level in the mask interior is higher than that of the atmospheric ambient pressure, wherein:

the pushing element comprises an elastic double clasp with two locking elements each on a side; and a moving together of the two locking elements of one side brings about a moving apart of the locking elements of the other side.

20. A gas mask comprising:

a mask body defining a mask interior;

a breathing port;

an expiration valve with a valve spring;

an adjusting element affecting a prestress of the valve spring;

a pushing element having a first switching position and a second switching position, the pushing element acting on the adjusting element during a translatory motion from the first switching position into the second switching position, so that a change in the prestress of the valve spring is brought about and there is a switchover from a normal mode in which a pressure level in the mask interior corresponds to atmospheric ambient pressure to an overpressure mode in which a pressure level in the mask interior is higher than that of the atmospheric ambient pressure; and a cover with two side openings, wherein the cover surrounds the pushing element, wherein:

the pushing element has side locking elements that protrude through the respective openings of the cover in the first switching position and in the second switching position and bring about locking of the pushing element in the first switching position and in the second switching position; and the locking elements have a grip area, by means of which the pushing element can be released from the locking and manually displaced.

* * * * *